US005157896A

United States Patent [19]

Tisma

[11] Patent Number: 5,157,896

[45] Date of Patent: Oct. 27, 1992

[54] MODULARLY CONSTRUCTED AUTOMATIC PACKAGING MACHINE

[75] Inventor: Stevan Tisma, Chicago, Ill.

[73] Assignee: Tisma Machine Corporation, Chicago, Ill.

[21] Appl. No.: 763,354

[22] Filed: Sep. 20, 1991

[51] Int. Cl.[5] ..... B65B 35/20; B65B 61/20

[52] U.S. Cl. ..... 53/252; 53/157; 53/238

[58] Field of Search ..... 53/252, 251, 253, 250, 53/249, 257, 255, 258, 260, 157, 155, 156, 238, 242, 136.2, 136.1, 135.2, 139.5, 474

[56] References Cited

U.S. PATENT DOCUMENTS 3,982,382 9/1976 Vogel ..... 53/252
4,350,002 9/1982 Focke ..... 53/252 X
4,553,659 11/1985 Reim et al. ..... 53/252 X
4,578,927 4/1986 Scarpa et al. ..... 53/252 X
4,982,556 1/1991 Tisma ..... 53/252 X
5,072,573 12/1991 Tisma ..... 53/252

*Primary Examiner*—James F. Coan
*Attorney, Agent, or Firm*—Laff, Whitesel, Conte & Saret

[57] ABSTRACT

An improved packaging machine having a positive retention mandrel device and positive discharge pusher means for transporting semi-rigid containers from one conveyor to a second conveyor. A broad size latitude conveyor providing accurate positioning of such containers for transfer from said conveyor to a second conveyor. A system for utilizing a draped unfettered leaflet for telescopic introduction into a box by employing an inverted semi-rigid bottle as the insertion mechanism with the leaflet ending up in embracing relation to the bottle cover.

20 Claims, 6 Drawing Sheets

MODULARLY CONSTRUCTED AUTOMATIC PACKAGING MACHINE

This invention relates to automatic packaging machines and more particularly to automatically controlled and modularly constructed packaging machines.

BACKGROUND OF THE INVENTION

Automatic packaging machines are used for many purposes, for example, inserting almost anything, such as candy, food, small parts, pharmaceuticals, e.g. pills, capsules, etc., in measured amounts into a first container and thence into external display containers, e.g. boxes, bags, etc.,tamper-proof or otherwise. These display containers may also include instruction or cautionary material concerning the use of the contents which must be inserted appropriately into the display container.

There is a great amount of prior art concerning the measurement of specific quantities of goods for packaging, their insertion into packages, and the final sealing or glueing before distribution to the retailer. While many of the dispensing mechanisms rely on gravitational forces to move the product, there is a great need to positively control the movement of the product so that the equipment can move in a substantially continuous manner, rather than in a time consuming intermittent fashion.

To further the teachings of my own prior art, as set forth in U.S. Pat. No. 4,982,556, issued Jan. 8, 1991, for a MODULARLY CONSTRUCTED AUTOMATIC PACKAGING MACHINE, a continuation-in-part of Ser. No. 164,010 filed Mar. 4, 1988 and issued as U.S. Pat. No. 4,856,566, the usage of modular construction permits a great number of advantages, as spelled in those patents, but the necessity of positive control over a semirigid container, such as a bottle, during its transfer between modules requires additional means mounted on a universal type of module which will be adjustable to various sizes within the design limits of the module. In this art the various control items, mounted in spaced relation on a continuous chain over an endless closed path, are collectively normally referred to as mandrels.

OBJECTS OF THE PRESENT INVENTION

Thus, it is an object of the present invention to provide a new and novel mandrel unit that can be made a part of such a modular construction and which is capable of carrying product containers from one location to another and further provides means for positive discharge of such product container from the mandrel unit.

Another object of the present invention is to provide means for spring loaded gripping of the packaged product at one end of a mandrel while means are provided at the other end for positive ejection of such packaged product at a predetermined location.

Still another object of the present invention is to provide suitable cam means for opening the gripping means to their maximum extent, insertion of the product into the gripping means, release from the cam control and activation of the spring-loaded or cam operated gripping of the product for control in movement from one location to the next.

A further object of the present invention is to provide a suitable cam means for moving a spring-loaded mandrel coaxially into the space between the gripping means to positively eject the product.

Another object is to provide a method for providing an instruction leaflet in freely disposed draped relation to an open-ended box for insertion by being telescoped into the box by the bottle container being introduced into the box and serving as a pusher or mandrel with the leaflet embracing the bottle.

Still another object is to provide a plurality of timed conveyors that are horizontally disposed in predetermined array and with a portion thereof in overlying synchronized relation, and a vertically disposed conveyor having substantial width, adequate to accept and maintain a bottle in an upright position in either normal or inverted relation. This conveyor includes a plu·ality of abutment means that are spaced a predetermined distance that corresponds to the spacing of the next type of mandrel to which the product is to be transferred.

Additional objects will become apparent to those skilled in the art when the specification is read in conjunction with the accompanying drawings.

DETAILED SPECIFICATION

Figure 1A:
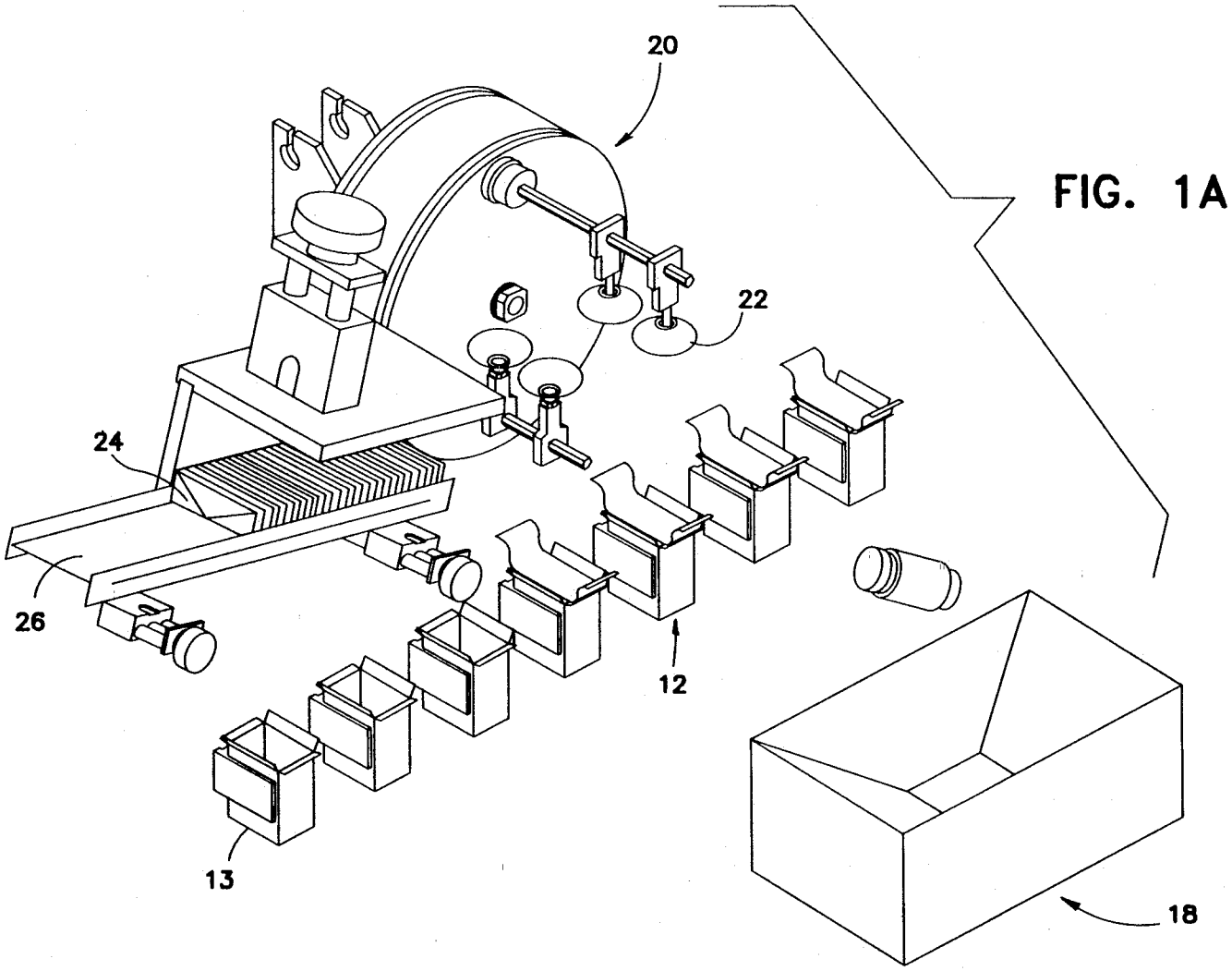
FIG. 1 is an exploded perspective view of various elements or modules of a packaging machine embodying the present invention.
Figure 1B:
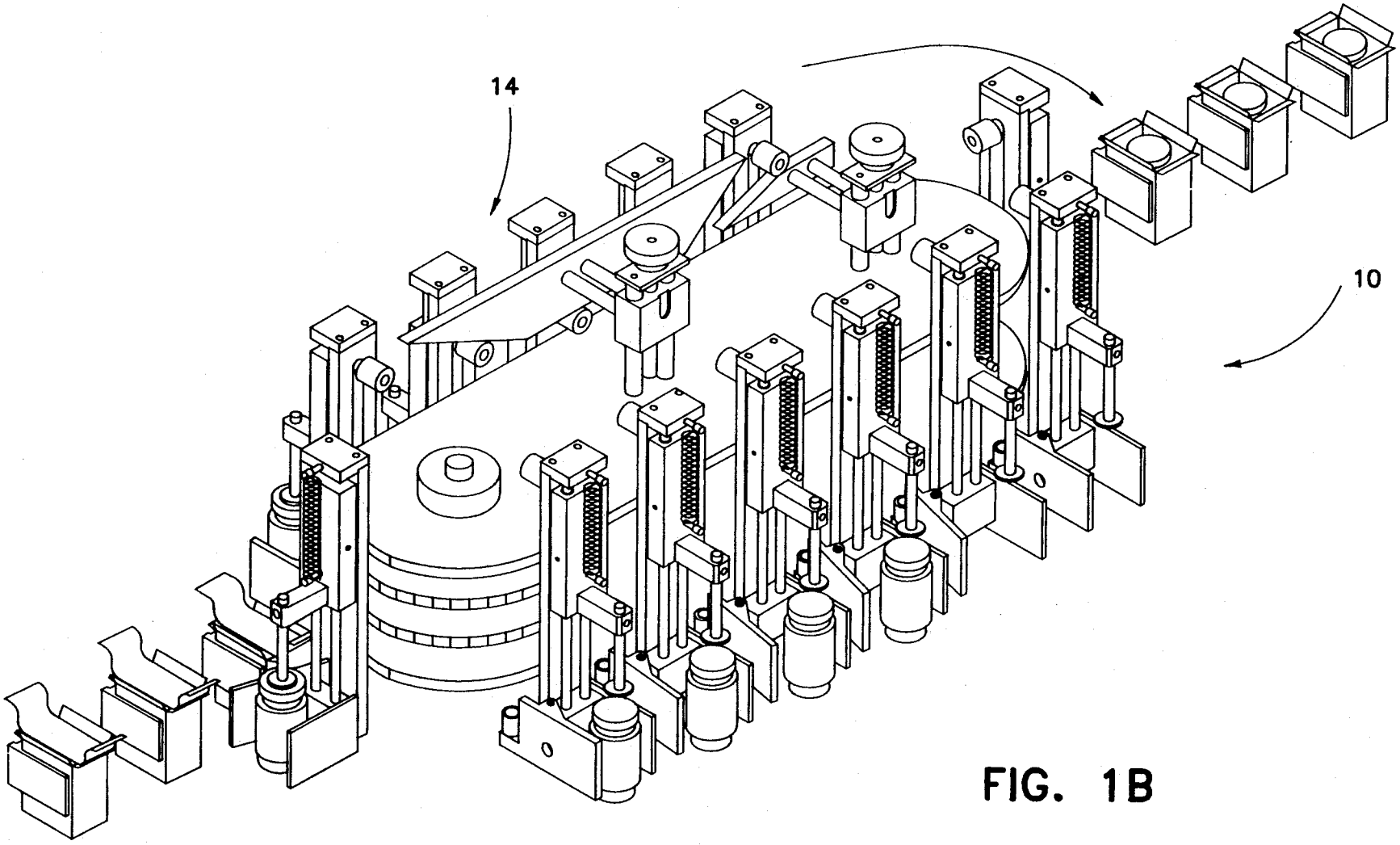
Figure 1C:
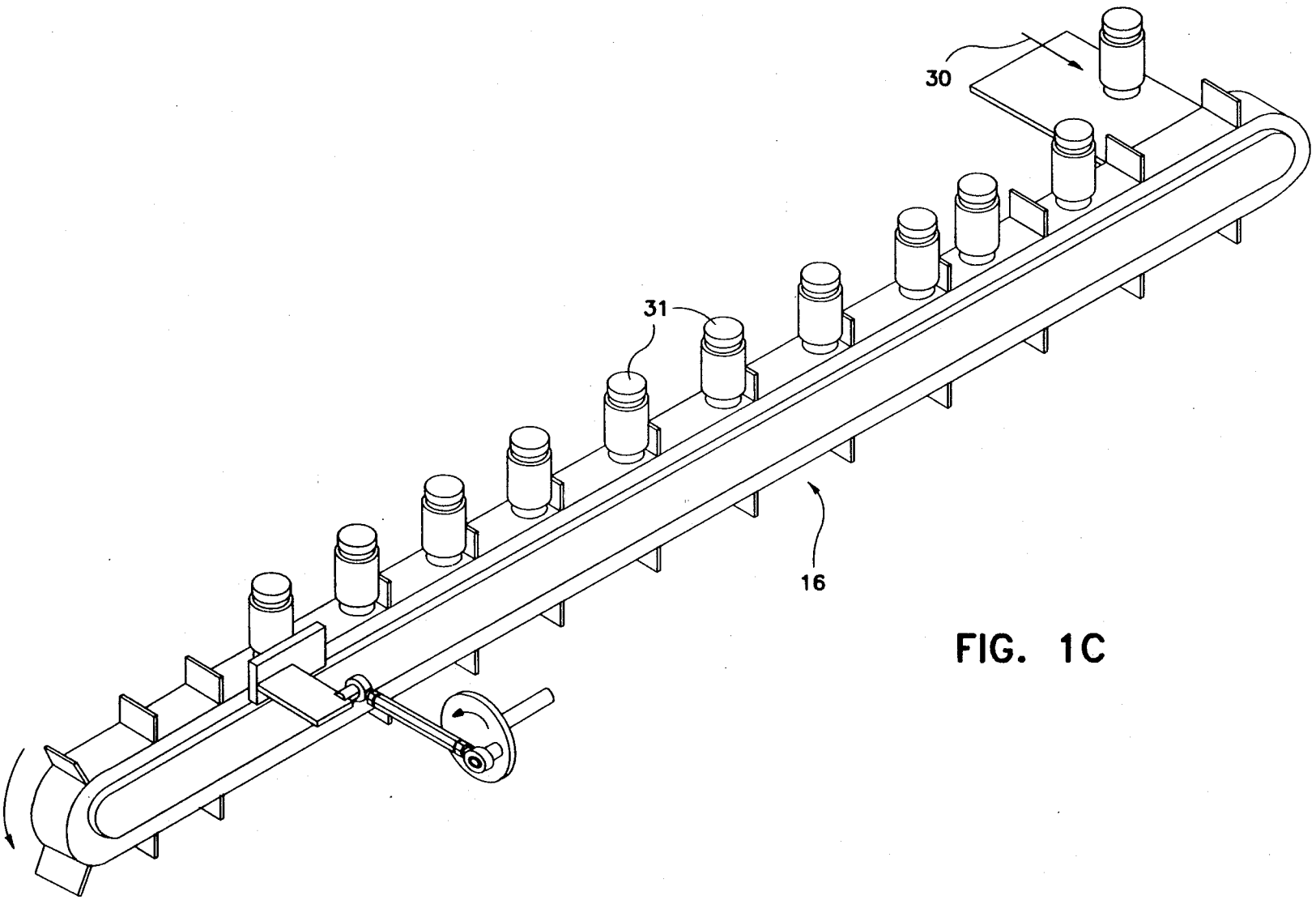

Referring now to the drawings, wherein similar parts are designated by similar numerals, the machine 10 contemplated by the present invention and included in this primary embodiment includes a plurality of modular timed synchronized conveyor units 12, 14 and 16. It should be pointed out that unit 12, although being a closed end elongated loop, is schematically illustrated by only the formed boxes that would normally follow one leg of the conveyor, for purposes of clarity in illustration. Such a packaging machine would also include the normal delivery means for box blanks, forming dies for such boxes, delivery means for previously filled rigid containers, e.g. bottles or the like, reject collection receptacles 18, and delivery units 20 for instruction or warning materials to be installed in the boxes along with the rigid containers.

The lower conveyor 12, as is normal, will include mandrel means for accepting box blanks or preassembled open-end boxes in spaced relation. As the boxes 13 progress in spaced synchronized fashion, controlled by suitable programmable electronic means, not shown, the delivery unit 20 will have its suction cups 22 pick up a substantially flexible information leaflet, flyer, card, warning, etc.,designated 24, from the stacking supply tray 24 and place the flyer in freely disposed overlying draped relation to each of the boxes 13. In the prior art, it normally is considered necessary to hold the indicia means by fixed means during the insertion into the box.

In the mean time, on the other side of the packaging machine 10, a supply 30 of prefilled containers, i.e. bottles 31, are introduced to the conveyor 16. The conveyor 16 includes a plurality of spaced protuberances or fences 34 having a predetermined interval. In this embodiment the fences 34 are spaced a substantial distance greater than the diameter of bottles 31. However, the introduction of the bottles 31 from supply 30 results in the bottles all resting against and driven by the fences 34 thereby insuring the accurate positioning and spacing of bottles 31 for synchronous transfer to the next conveyor 14, as will be explained hereinafter. It should be noted that conveyor 16 is shown being displaced laterally from conveyor 14 to a greater degree than is normal, for purpose of clarity in illustration.

Referring now to FIGS. 2, 3, and 4 through 4C, an improved mandrel 40 includes an elongated vertically disposed rigid base 42 having a centrally disposed elongated slot 44. An upper rigid flange 46 is recessed 48 along one edge to accept base 42 and fastened thereto by appropriate fastener means 50, such as screws. At the opposite, or lower end as viewed in the drawings, there is a second cantilever flange 54. Flanges 46 and 54 are both recessed by appropriate bores 56 to accept a pair of spaced rigid slide rods 58 that accommodate and guide slide 60, which may if desired include bearings 62 for friction reduction. A tension spring 64 is retained at opposite ends by capscrew 66 threaded into flange 46 at the top end and by capscrew 67 threaded into the slide 60 near its lower end. (This arrangement of the spring 64 is not shown in FIGS. 4A–4C for purposes of clarity in illustration.). Slide 60, at its lower end, carries a forwardly extending rigid arm 68 with a vertical bore 70 adjacent its end adapted to accept an ejector rod 72 having an enlarged pusher head 74 at its free end and a retaining adjustment set screw 76 extending transverse to bore 70 for adjusting the axial position of head 74.

At the lower end of base 42 on lateral side of base flange 54 there is positioned a rigid fixed arm 80, as by screws 82. On the opposite side of base flange 54 there is positioned a spring loaded movable arm 84 having a tapered partial upper flange 88 and a similar partial lower flange 86 that embrace the base flange 54 and carry a pivot pin 90 which the free end of arm 84 to move relative to the fixed arm 80. The lower flange 86 includes a rearward projecting extension 92 having an upwardly extending axle 93 adapted to carry cam follower 94. An adjustable backstop 96 extends from rigid arm 80 into the throat of the gripping means and is adjustable as by the slots 98 and set screws 100.

Positioning of slide 60 and pusher head 74 in the operation of the machine is accomplished by a rearward extending axle 102 projecting from slide 60 through the elongated slot 44 and presenting another cam follower 104, whose function is described hereinbelow.

Conveyor 14 is generally comprised of a closed endless path defined by the chain-drive means 110 sandwiched between a pair of rigid plate-like members 112 and 114 and, which among other things, serve as the support for the axle bearings 116 supporting the shaft of the sprocket members engaged with the chain-drive 110. A plurality of improved mandrels 40 are spaced along and fastened to the chain-drive means 110, as is well known in the art, and provide the gripping means to open outwardly therefrom. As can be best seen in FIGS. 2 and 3, the upper plate-like member 114 carries cam means, generally designated 120 and 122, which are adapted to engage the upper cam follower 104; while the lower plate-like member 112 carries cam means (not shown) which are adapted to engage lower cam follower 94 which will activate and move the moveable arm 84 for gripping the bottles 31.

Figure 3:
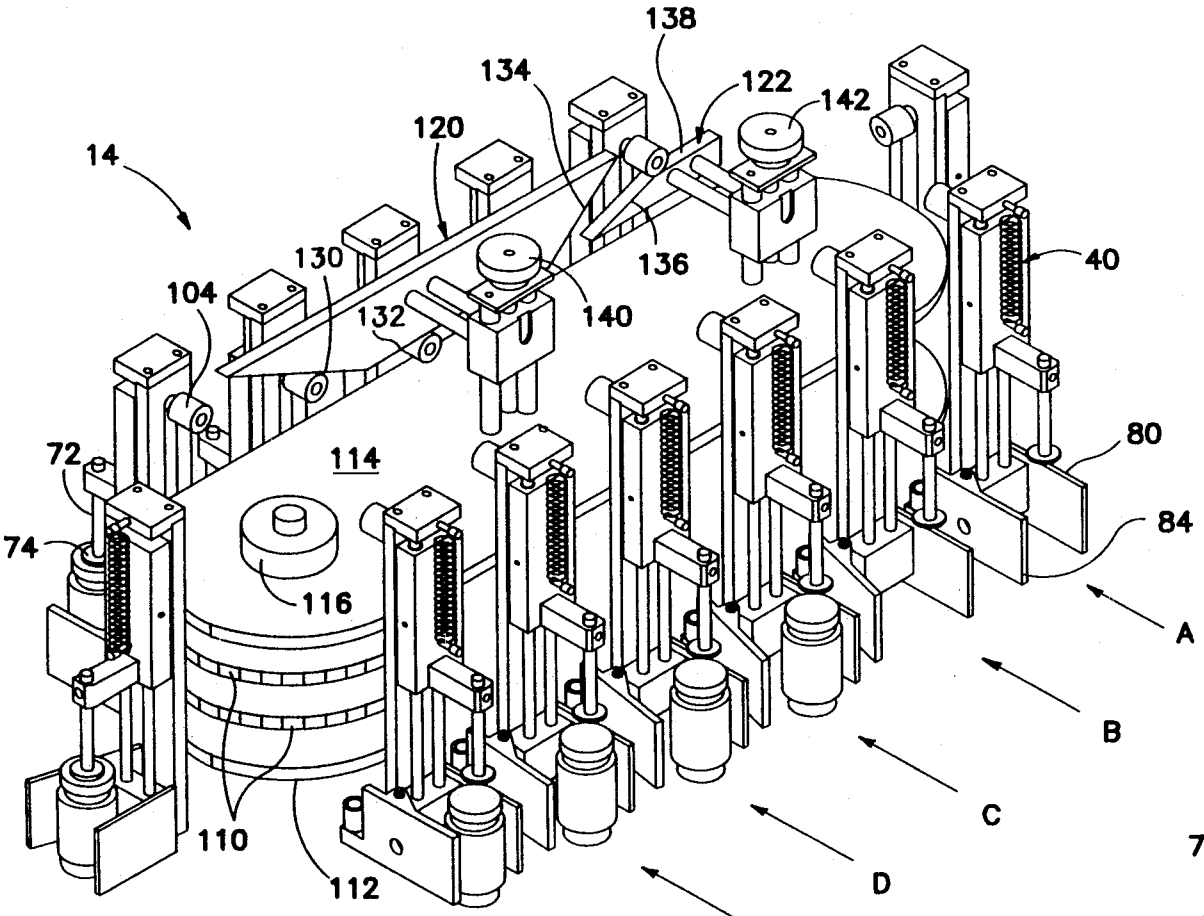
FIG. 3 is a further enlarged perspective view of the module of the present invention that incorporates the improved gripping mandrel contemplated by the present invention.
Figure 4B:
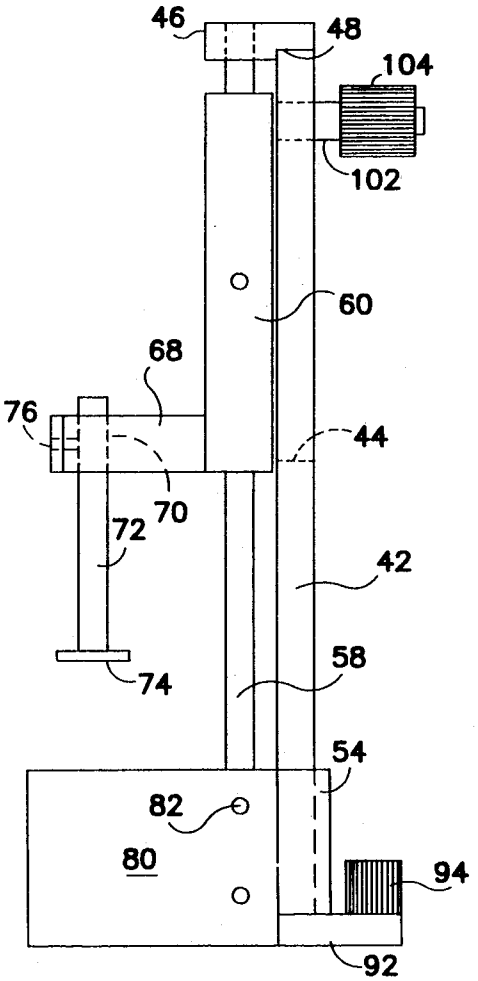
FIG. 4B is a side elevation view of the device shown in FIG. 4 as taken along line 4B—4B.
Figure 4A:
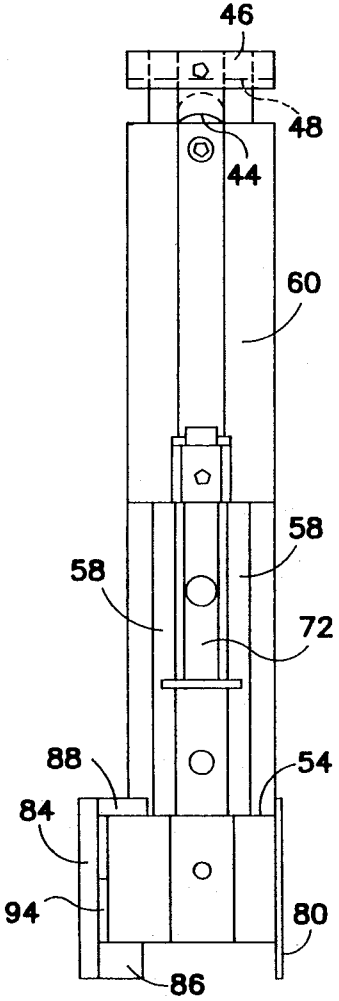
FIG. 4A is a front elevational view of the device shown in FIG. 4 as taken along line 4A—4A.
Figure 4:
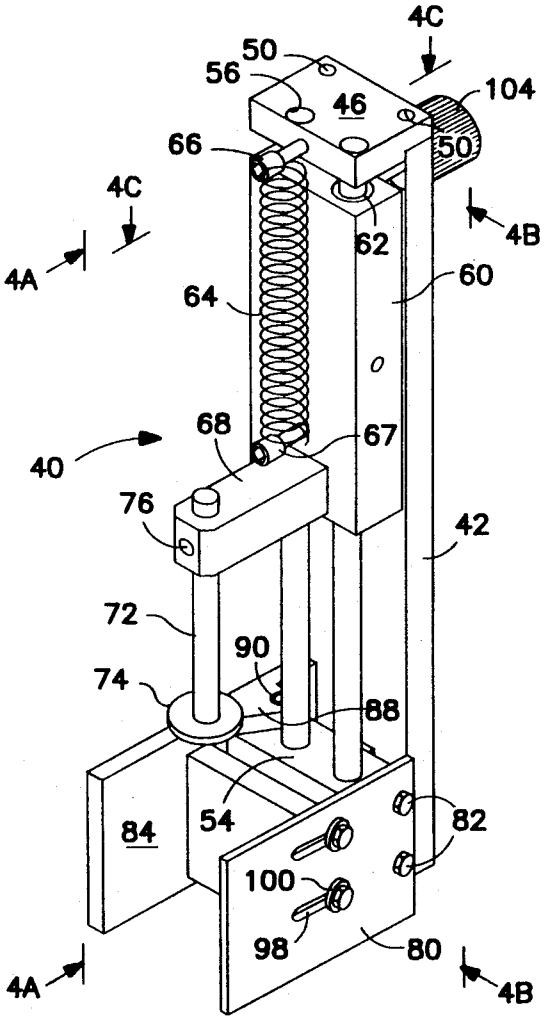
FIG. 4 is an enlarged perspective view of the improved combined gripping and ejecting mandrel of the type contemplated by the present invention.

As can be best seen in FIG. 3, the conveyor 14 preferably, in this embodiment, moves in a clockwise direction through a series of stations during the transfer of the bottles 31 from the conveyor 16 to the conveyor 14. These hypothetical stations, the conveyor normally moves at a constant speed and does not pause at each station, have been designated by the arrows and letters, A-F. At station A, it will be noted that the arms 80 and 84 are generally parallel. At station B the moveable arm 84 has opened or moved to the left to increase the size of its throat. The enlarged throat is continued by cam action in station C where the bottle 31 is moved by pusher ar 124 and block 125 activated by the eccentric crank 126 moved in synchronized fashion with the conveyor 16 in the direction of the enlarged arrow 128. (It will be appreciated that a planar surface is provided, although not shown, between conveyors 16 and 14 for supporting the bottles 31 during this transfer). At stations D, E, and F the moveable arm 84 is brought into engagement with the bottle 31 until at station F the bottle is firmly gripped between the fixed arm 80 and the moveable arm 84. For clarity in illustration, mandrels 40 have been omitted at the rounded ends, for example, where the numerals 110 and 112 are located in FIG. 3.

Figure 2:
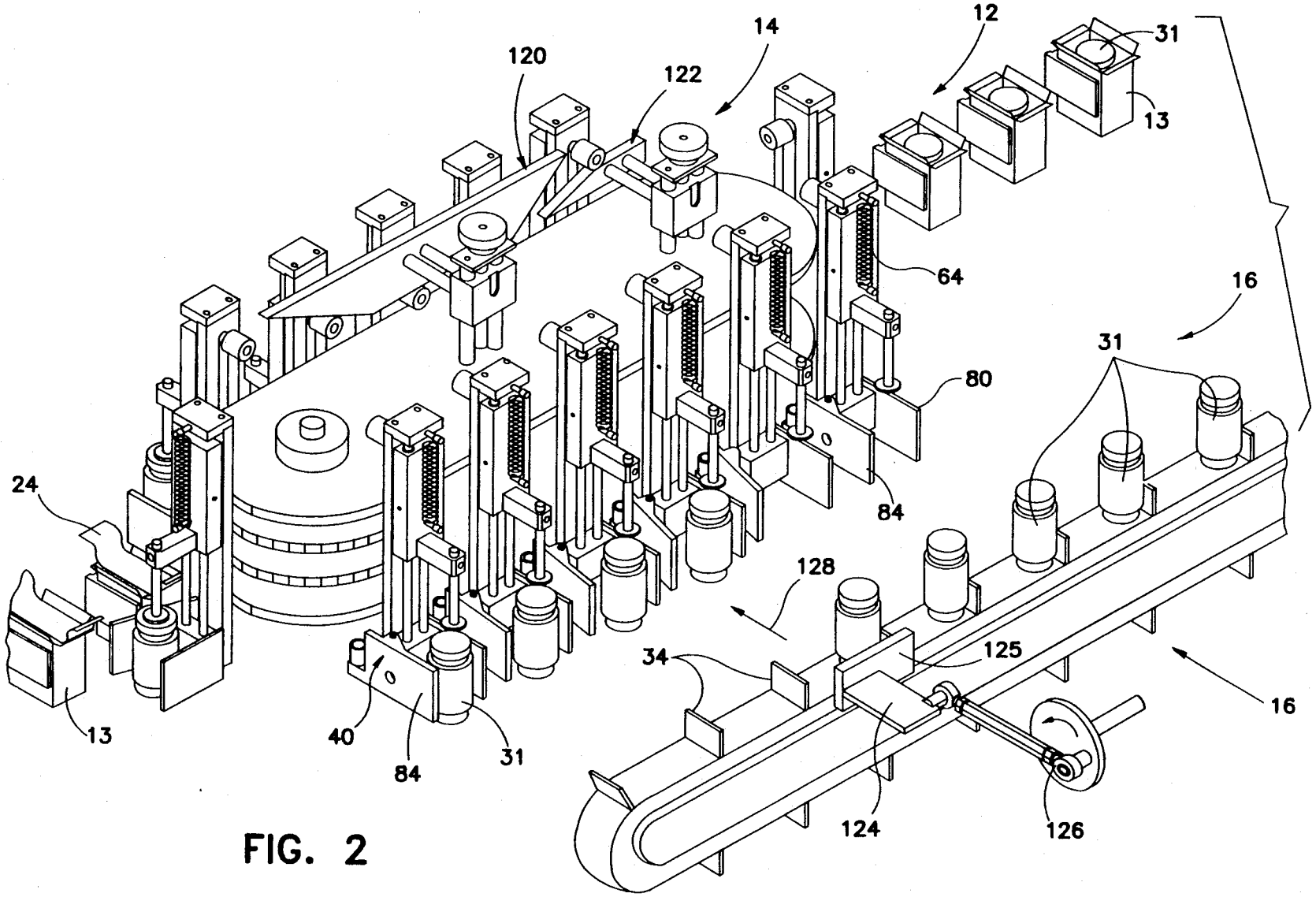
FIG. 2 is an enlarged exploded perspective view of a portion of the machine shown in FIG. 1.
Figure 4C:
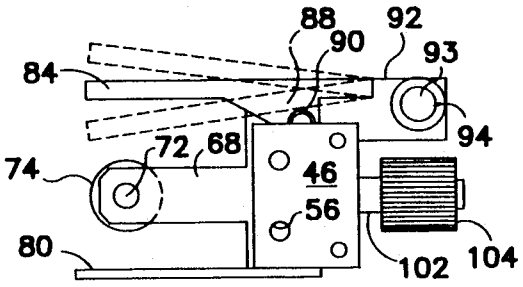
FIG. 4C is a top plan view of the device shown in FIG. 4 as taken along line 4C—4C.

On top of the rigid plate-like member 114 there are locate cam means 120 and 122. As the mandrels 40 move in a clockwise direction around the chain-drive 110, the cam follower 104 of each mandrel 40 is brought into engagement with an angularly disposed surface 130 which causes the slide 60 to be moved downward with its integral pusher head 74 until it reaches the flat or dwell surface 132. Similarly, cam means carried by the lower plate 112 will engage cam follower 94 and cause the moveable arm 84 to open the throat between arms 80 and 84 and permit the pusher head 74 to engage the bottle 31 and force it against the leaflet 24 and telescope both the leaflet 24 and bottle 31 into embracing relationship within the box 13 (FIG. 2). Sometimes, laws, rules, or regulations, requires the leaflets to be folded over the tops of the bottles. If so, the bottles are loaded upside down in an inverted position onto conveyor 16. Then, the top of the bottle is pushed downwardly against leaflet 24. As the conveyor continues on its journey the cam follower 104 will ride up surface 134 with assistance from the upwardly inclined surface 136 and dwell flat 138 on cam 122 to its fully retracted position with a strong assist from the tension spring 64 to retain the pusher head 74 in fully retracted position.

Both cam 120 and cam 122 are supported by adjustable means 140 and 142, respectively, to permit this type of modular conveyor to be adjusted to compensate for varying sizes of bottles to be assembled with boxes and indicia means.

This invention is unique in that the conveyor 16 can accept a multiplicity of bottle sizes and with the bottles always perfectly positioned for transfer to conveyor 14 since the abutment fences 34 are spaced apart the distance between adjacent fixed arms 80 on adjacent mandrels 40. Therefore, adjustments for size changes, within the limits of the throat produced by the fixed 80 and moveable 84 arms of mandrel 40 and the spacing of abutment fences 34, are minimal to non-existent and hence equipment conversions between packaging runs of different size bottles is greatly reduced, resulting in great cost savings.

The wide spacing of the abutment fences 34 permits a freer movement of the bottles 31 from the supply 30. The use of the fence 34 as a reference point and driver in the movement of the bottles permits faster loading operation of the bottles 31 onto conveyor 16 whether they are in the normal or inverted position. The tapered throat formed between the flexed open adjustable arm 84 and the fixed arm 80 also permits a wider latitude in the transfer operation by the eccentric crank 126 and pusher arm 124 with its forward wall 125.

The method of draping the leaflet 24 over the open mouth of the box 13 increases the speed of operation. Previously, the leaflet was introduced when a box was disposed with the open end on its side and, hence, the leaflet had to be held by grippers in a vertical array. This took more time and the present method of draping the leaflet freely reduces both the time and cost of the leaflet insertion.

The transfer of the bottles 31 by the mandrel 40 is another increase in precision and a positive step in quality control and accuracy in operation. When the bottles are in the inverted position they will cause the telescoped draped leaflet to be brought into embracing relationship around the mouth of the bottle, a requirement of the FDA, for informing the ultimate user of the proper dosage and any inherent dangers that might exist prior to usage of the pharmaceutical.

As is well known in the packaging equipment art, this equipment contemplates the use of a microprocessor for the control and synchronization of the multiple conveyors employed. There, additionally, are a plurality of sensors that feed data to the microprocessor concerning the presence or absence of leaflets, boxes, or bottles, at any particular station, with the microprocessor determining the necessity of skipping various mandrels due to the absence of one or more elements, or stopping the entire operation if the errors exceed a predetermined frequency.

Other advantages will be apparent to those skilled in the art and applicant desires to be limited only by the claims attached.

I claim:

1. An automatic packaging machine comprising a plurality of conveyors for transporting items around synchronized closed paths, said closed paths coinciding in areas where items are transferred from one closed path to another closed path, at least one of said conveyors having suitable means for sequentially carrying spaced open container means, at least one other of said conveyors having adjustable means for grippingly carrying complimentary product means into at least one of said coinciding areas in a vertical condition, said adjustable gripping means also having integral means for axially moving said product means out of said gripping means into one of said open container means when said gripping means is released, said at least one other of said conveyors being disposed in a juxtaposed generally horizontal plane, still another closed path disposed in a substantially vertical plane and providing an upper and lower oppositely directed segments moving at opposite ends of said closed path around axes generally horizontally disposed, said upper segment providing sychronized pockets for accepting said product means and sychronizable means for moving said product means out of said pockets into position for grabbing by said adjustable gripping means.

2. The machine as claimed in claim 1 wherein a flexible insert is positioned in freely overlying draped relation to said open container means and adapted to be deformed into an embracing relationship with said product means when said product means is telescoped axially with said insert into said open container means.

3. The machine as claimed in claim 1 wherein said complimentary product means is a complimentary shaped bottle filled with product.

4. The machine as claimed in claim 2 wherein said complimentary product means is a complimentary shaped bottle filled with product.

5. The machine as claimed in claim 4 wherein said container is a box with its top end sealed and positioned within one of a series of mandrels spaced about said closed path and said bottle is inserted in inverted position into said box through the open bottom end of said box, whereby said flexible insert is telescoped over the top of said bottle and embracing the means for providing ingress into said bottle whereby the ultimate user of the contents of said bottle is made aware of the limitations imposed upon its use by said insert prior to opening said bottle.

6. A machine as claimed in claim 1 wherein said open container is initially sealed at its normal upper end and maintained in inverted position on said conveyor with its open bottom end exposed for acceptance of said inverted product means, a flexible insert freely disposed over said open bottom end and drawn into said container and captured therein in embracing relation around the top of said product means, and means for sealing the open bottom end with said bottle and insert captured therein.

7. A machine as claimed in claim 1 wherein said at least one conveyor means includes a pair of spaced sprocket wheels carrying an endless closed path chain means, a plurality of spaced mandrel cavities supported by said at least one conveyor, each cavity being adapted to accept and expose an open ended container means, said at least one conveyor means lying in a generally horizontal plane with said spaced pair of sprocket wheels having their axes disposed generally normal to said horizontal plane, said at least one other conveyor including an endless chain means forming a closed path lying in a generally horizontally disposed second plane substantially parallel to said horizontal plane, each said adjustable gripping means being positioned at one end of a vertically disposed rigid body positioned and carried in a vertical position on said at least one other conveyor and controlled by cam means fixedly mounted in juxtaposition to the closed path of said at least one other conveyor.

8. A machine as claimed in claim 7 wherein said body and its adjustable gripping means includes a pair of laterally extending arms, said arms having one fixed arm and a movable spring actuated cam controlled opposing arm capable of providing variable gripping means within predetermined limits of movement of said movable opposing arm.

9. A machine of the type claimed in claim 8 wherein said body includes a moveable slide member carrying a laterally extending portion overlying said gripping means, said portion adapted to adjustably accept mandrel means fixed to said portion and adapted for penetrating the space between said fixed and moveable opposed arms to cause discharge of said product means gripped by said arms.

10. A machine as claimed in claim 9 wherein said moveable slide has a cam follower extending outwardly in the opposite direction from said laterally extending portion and adapted to engage fixed cam means justaposed to said moving conveyor, said body carrying said slide and gripping means being moveable in timed relation to said at least one conveyor means whereby each said body is positioned in overlying relation to each said cavity carrying said open ended box and said cam actuated slide carrying its said mandrel is disposed to deliver its grippingly carried product means into said box.

11. A machine as claimed in claim 10 wherein means are provided to dispose generally flat flexible indicia means in overlying unfettered draped relation to each said open ended box in said cavities, said indicia means being drawn into said box by the axial movement of said product means and disposed in embracing relation thereto.

12. A machine as claimed in claim 11 wherein said product means is a capped bottle carrying the product, said bottle being oriented in inverted position with said indicia means being caused to embrace the neck and cap means whereby the ultimate user of the product is exposed to any message on said indicia means prior to opening said bottle and using the contents.

13. A machine as claimed in claim 10 wherein said gripping means includes one fixed arm and one spring loaded cam controlled arm moveable between predetermined limits.

14. A machine as claimed in claim 13 wherein said spring loaded arm includes a first portion extending in moveable opposition to said fixed arm, a pivot point intermediate the extremities of said moveable arm, and a second portion extending on the opposite side of said pivot point away from said first portion and carrying suitable cam follower means for engaging cam means for controlling the movement of said second or moveable arm.

15. A machine as claimed in claim 14 wherein said machine also includes a third closed path conveyor having a predetermined width and spaced abutment means carried thereon, said third conveyor being disposed in a vertical plane and moveable around suitable drive means disposed on horizontal axis means which provides a moving horizontal surface having spaced pockets thereon defined by said spaced abutment means, said abutment means being spaced a distance comparable to the spacing of said fixed arms on adjacent ones of said gripping means, whereby synchronization of said gripping means with said abutment means will insure accurate positionment of said product means for gripping, and means for moving said product means off of said moving horizontal surface into suitable position between said gripping arms in synchronized relationship for secure gripping therebetween, said grippingly arms having suitable means for opening said arms an adequate distance to readily accept said product means and then released to close inwardly toward one another to actively grip said product means.

16. An automatic packaging machine insertion mandrel means including a rigid backing member adapted to be mounted vertically on an endless path conveyor, said backing member including elongated aperture means, spaced top and bottom support means projecting forwardly in cantilever fashion in the same direction from opposite ends of said backing member, slide support means spaced in generally parallel relation to said rigid backing member, said slide support means secured at its opposite ends to said spaced forwardly projecting support means, slide means moveable along said slide support means in spring loaded fashion, first cam follower means extending rearwardly from said slide means through said elongated aperture means, spring-loaded gripping means projecting forwardly from said bottom support means, mandrel means supported in spaced relation to said slide means and extending axially downwardly in aligned generally coaxial relation to the space between said spring-loaded gripping means for dislodging product means gripped by said gripping means, means for controlling the spacing between said gripping means to adjust to the product means to be gripped.

17. A feeding mandrel device for use in an automatic packaging machine, said device including a rigid vertically disposed base member, means for supporting said base member on a closed path conveyor means, means supporting a cam actuated slide member for movement along said vertically disposed base member, gripping means for retention of suitable product means, said gripping means spaced from and disposed below said slide member, said slide member carrying a vertically disposed pushing mandrel so disposed as to move into the space between said gripping means and thereby eject product means gripped by said gripping means.

18. An automatic packaging machine for inserting product into a container with a leaflet draped over said product, said machine comprising first conveyor means for transporting a plurality of said containers to an inserting station, said container having a product receiving opening at its top side as it approaches said inserting station, means for laying a copy of said leaflet over the top side of and across the opening in each of said containers as it approaches said inserting station, said leaflet resting under gravity on said container, and means at said inserting station for pushing said product into said opening, draping said leaflet over said product as it is pushed.

19. The machine of claim 18 wherein said product is an inverted product so that said leaflet is draped over the top of said product.

20. The machine of claim 18 wherein said product is a bottle.

* * * * *